United States Patent [19]

Lee et al.

[11] 3,990,940

[45] *Nov. 9, 1976

[54] PULP MOLDING SYSTEM INCLUDING A FLEXIBLE MOLD CARRYING BELT AND AN ELASTIC PRESSING BELT

[75] Inventors: Charles A. Lee; Warren R. Furbeck, both of Knoxville, Tenn.

[73] Assignee: International Paper Company, New York, N.Y.

[ * ] Notice: The portion of the term of this patent subsequent to Apr. 9, 1991, has been disclaimed.

[22] Filed: Mar. 14, 1974

[21] Appl. No.: 451,052

Related U.S. Application Data

[63] Continuation-in-part of Ser. No. 114,514, Feb. 11, 1971, Pat. No. 3,802,963.

[52] U.S. Cl. ..... 162/227; 162/228; 162/388; 162/389; 162/390; 162/395

[51] Int. Cl.[2] ..... D21J 7/00

[58] Field of Search ..... 162/218, 219, 228, 220, 162/264, 227, 380, 387, 388, 389, 329, 390, 315, 348, 367, 363, DIG. 1, 383, 382, 351, 116, 364, 374, 395, 396

[56] References Cited

UNITED STATES PATENTS

| | | | |
|---|---|---|---|
| 3,167,469 | 1/1965 | Wells | 162/395 X |
| 3,802,963 | 4/1974 | Lee et al. | 162/219 |
| 3,890,195 | 6/1975 | Lee et al. | 162/387 |

*Primary Examiner*—S. Leon Bashore
*Assistant Examiner*—Richard V. Fisher

[57] ABSTRACT

A method and apparatus for use in the manufacture of improved molded pulp products are disclosed wherein foraminous molds disposed over openings in a liquid impervious belt are moved beneath the surface of a flowing furnish and suction is applied to draw liquid through the molds and deposit a layer of pulp on each mold. Thereafter, the pulp deposit on each mold is simultaneously subjected to a generally uniform pressing with a second belt and suction which forms a smooth exposed surface on the pulp deposit and removes a portion of the liquid therein.

10 Claims, 11 Drawing Figures

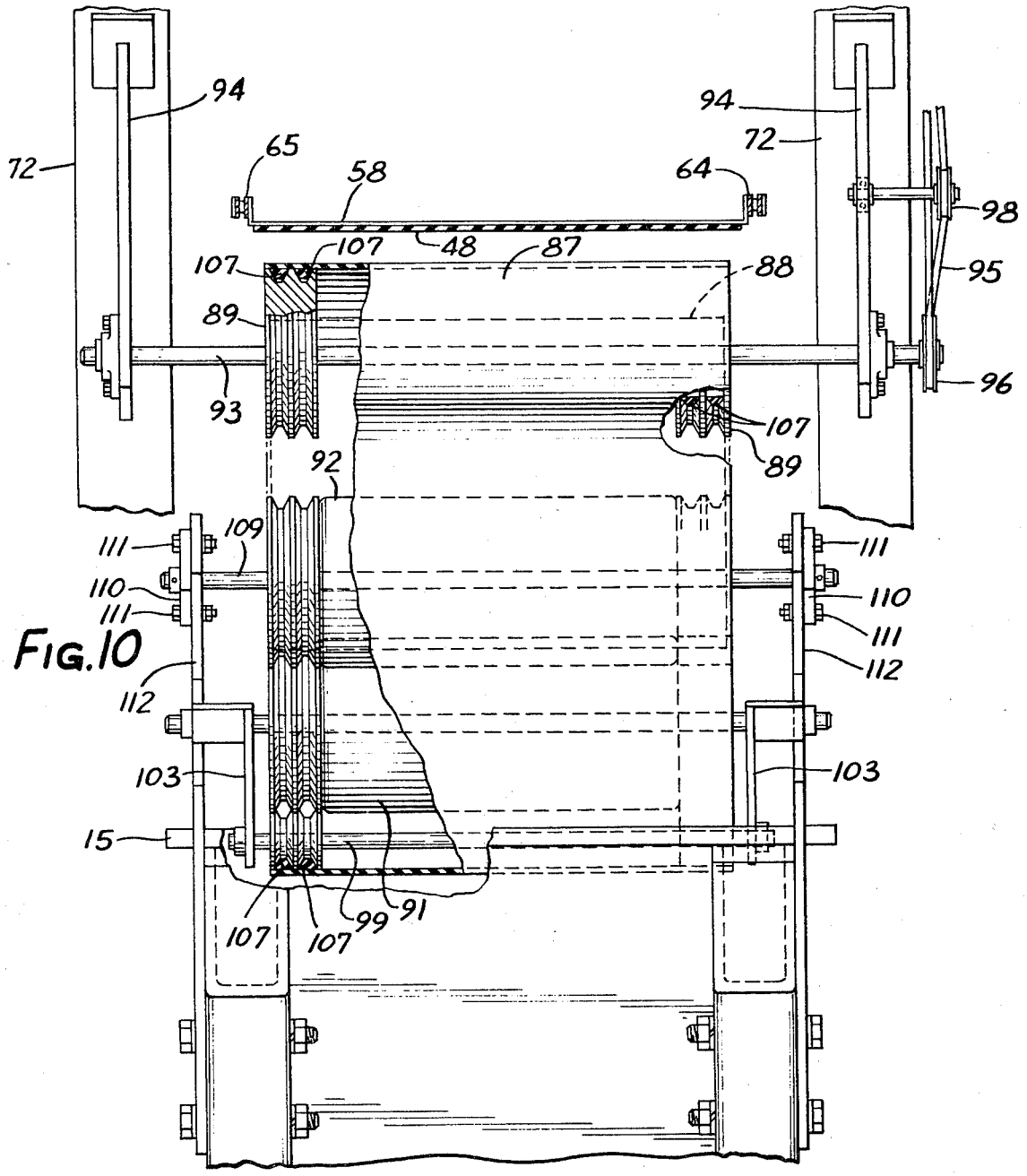
FIG. 10
FIG. 11
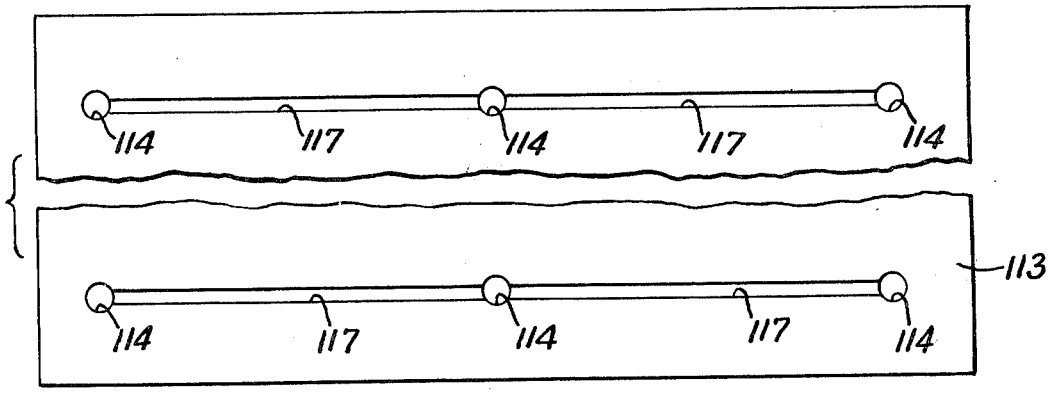

PULP MOLDING SYSTEM INCLUDING A FLEXIBLE MOLD CARRYING BELT AND AN ELASTIC PRESSING BELT

This is a continuation-in-part from application Ser. No. 114,514, filed Feb. 11, 1971, now U.S. Pat. No. 3,802,963, issued Apr. 9, 1974 and relates generally to molded pulp products and their methods of manufacture, and more particularly to a novel method and apparatus for simultaneously forming a smooth exposed surface on and removing liquid from a mat of pulp fibers disposed on a product mold after the mold is removed from a furnish channel in which the mat was formed on the mold.

Molded pulp products, e.g. paper plates, trays, egg cartons, and the like, have long been made by the process of matting pulp fibers in the form of a layer onto one side of a foraminous mold by the application of suction to one side of the mold while the other side is disposed in a furnish. The deposited mat generally conforms to the geometry of the mold and is usually dewatered and dried by pressing and by the application of heat to produce a self-sustaining molded product.

In manufacturing molded pulp products in the prior art, the molds were submerged in a furnish by various types of apparatus including devices where the molds were moved through the pool of furnish on rotating drums or spoke devices. Other prior art devices moved the molds into and through the furnish intermittently, as by cyclically dipping the molds into it.

The prior methods in general did not consistently produce uniform products. The products frequently exhibited nonuniform thickness and poor strength or other undesirable physical characteristics. Further, not infrequently, excessive pulp was required to obtain the desired product. The production rates possible with the prior art methods were low, thereby resulting in uneconomical operation. A further major deficiency of the prior art products involved the flocculation of fibers which caused aggregates of the fibers to be deposited in the product. The presence of these aggregates made it difficult to control the density of the product and resulted in random strengths throughout the product. These aggregates also created uneven surfaces on the product and destroyed the desired smoothness.

It is an object of the present invention to provide an improved molded pulp product and method and apparatus for its manufacture.

A more particular object of the present invention is an improved method and apparatus for forming smooth exposed surfaces on and removing liquid from pulp pads or mats disposed on product molds after the molds leave a furnish tank or channel in which pulp is deposited onto the molds.

Other objects and advantages of the invention will become apparent from the following detailed description of the invention taken in connection with the accompanying drawings in which:

FIG. 10 is a partial sectional view taken substantially along the line 10—10 of FIG. 9, with additional portions broken away and shown in section to better illustrate particular details; and FIG. 11 is a bottom view of the suction box taken along the line 11—11 of FIG. 9.

Broadly stated, the manufacture of molded fibrous products with apparatus as illustrated in FIGS. 1–11 is accomplished by flowing a pulp furnish through a confined channel under conditions of controlled flow and moving one or more foraminous molds with the flowing furnish along one boundary of the channel in the same direction as the flow of furnish and at a rate of forward travel correlated to the rate of flow of the pulp furnish, while suction is applied to one side of the molds to draw liquid through the molds and accumulate pulp fibers on that side of the molds exposed to the furnish.

Preferably, the furnish and molds are moved along an arcuate channel so as to enhance the economic aspects of manufacture through consistent production of uniform products at high output rates.

The product characteristics are selectively obtained by conditioning the flow of furnish through the channel so as to establish turbulent flow of the furnish within at least the upstream end of the channel and by moving the furnish through the channel at a substantially constant velocity along the entire length of the channel while maintaining the furnish which exits the downstream end of the channel at a relatively low consistency even though the volume of furnish is continually being reduced as it flows along the channel, due to suction applied through the foraminous molds. Preferably, the furnish velocity along the flow channel is established and maintained by selective reduction of the channel cross section along the direction of furnish flow. Also in a preferred embodiment, the volume of furnish overflowing from the channel at its downstream end is held at a substantial amount of the volume of the furnish introduced to the channel at its upstream end thereby aiding in maintaining the desired state of fiber distribution within the confined channel and aiding in a relatively low consistency in the furnish at the downstream end of the channel. The term "consistency" as used herein denotes the percentage, by weight, of fibrous matter in a furnish comprising fibrous matter and a liquid vehicle (normally water).

With reference to the accompanying drawings, one embodiment of apparatus for manufacturing molded fibrous products in accordance with the present invention includes a furnish makeup system 5 for supplying furnish to a forming unit 6 through which the furnish and molds are moved concurrently to deposit layer of pulp on the molds, and one or more dewatering systems 7, 8, 9 remote from the forming unit 6 where a substantial part of the water is removed from the wet pulp layers on the molds. The dewatered products are removed from the molds and collected.

Figure 2:
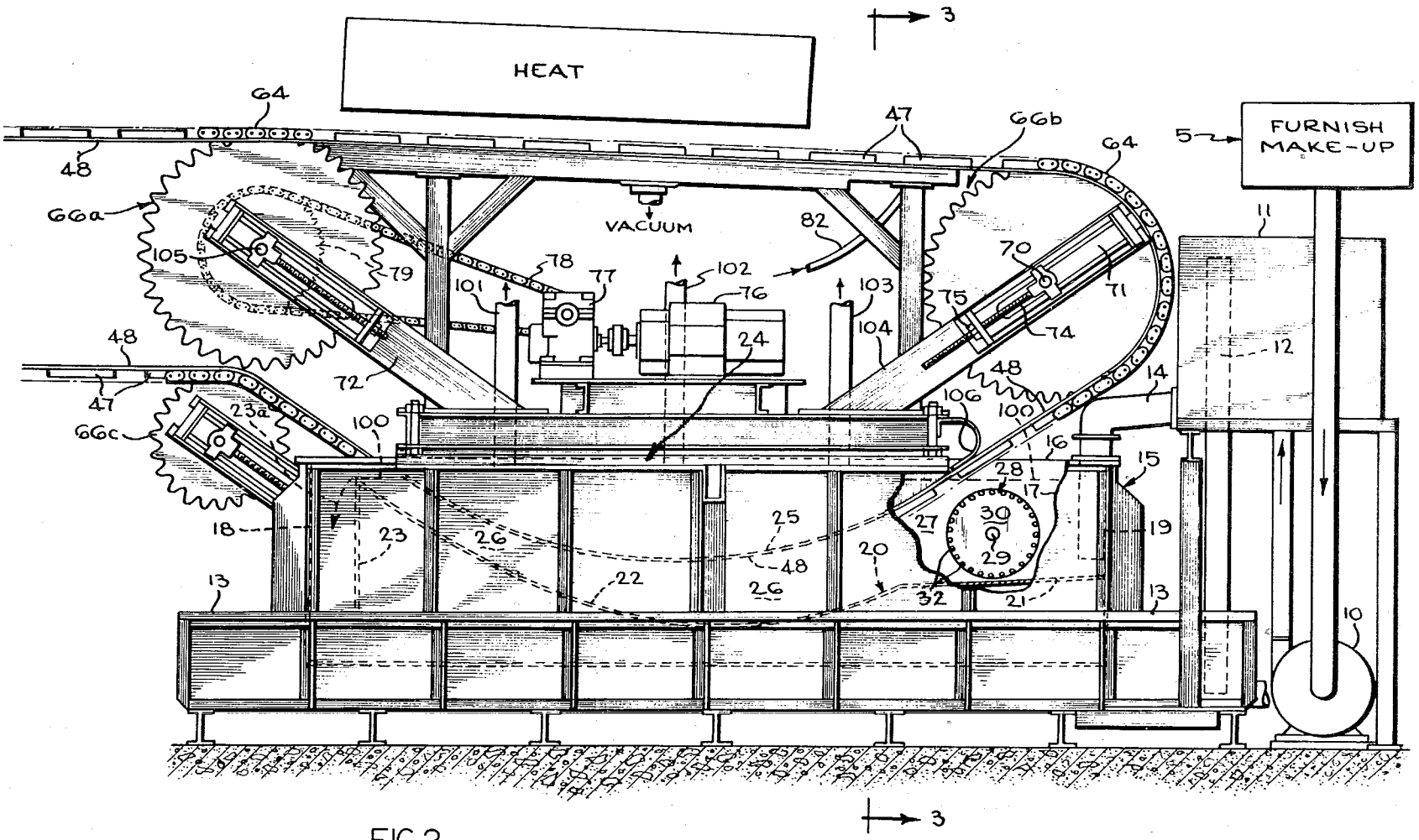
FIG. 2 is a side elevation, partially cut-away, of a portion of the apparatus of FIG. 1.
Figure 3:
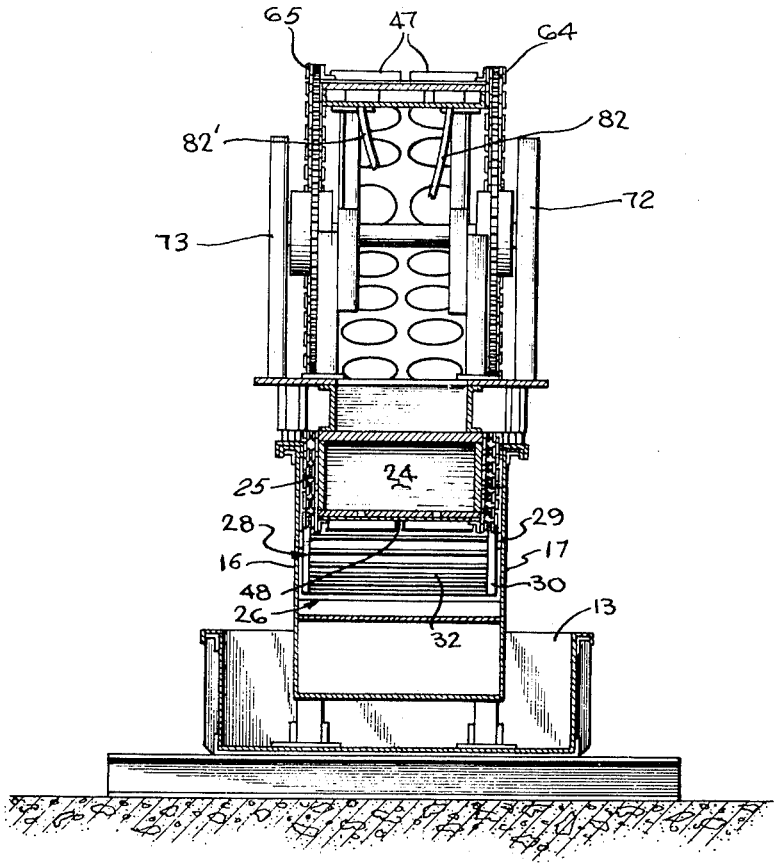
FIG. 3 is a sectional view taken along line 3—3 of FIG. 2.

Referring specifically to FIG. 2, a pulp furnish is pumped by a pump 10 from a furnish makeup system 5 through a conduit to a headbox 11. Within the headbox, the furnish may be agitated and may include means to recirculate a portion of the furnish to the pump 10 for mixing with the incoming stream from the furnish makeup system. Also, overflow means comprising a standpipe 12 (FIG. 2) leads from the headbox to a machine chest 13 to establish a preselected liquid level, hence pressure head, in the headbox 11. From the headbox 11, the furnish flows through a header 14 into an elongated forming tank 15. Preferably, the header 14 is wide enough to deliver furnish over substantially the entire width of the tank 15 and terminates adjacent the bottom of the tank to minimize the entrainment of air.

This forming tank 15 is generally rectangular in form and comprises parallel side walls 16, 17 (see FIG. 3 also) and end walls 18 and 19. Within the tank 15 there is provided a contoured bottom wall 20 defining a first, generally planar, downwardly inclined portion 21 adjacent the upstream end of the tank (the end adjacent the end wall 19) and an arcuate portion 22 which forms a concave bottom wall extending downstream from the portion 21 to a point adjacent, but spaced from, the downstream end of the tank 15 (the end adjacent the end wall 18) as illustrated. At the downstream end of the arcuate bottom portion 22, a transverse partition, defining a weir 23, establishes the vertical level 100 of the furnish overflowing the tank. This overflow is indicated by the arrow 23a in FIG. 2 and the overflowing furnish is collected in the machine chest 13 from which it may be recirculated to the furnish makeup unit 5 by suitable means (not shown).

A elongated suction box 24 having an arcuate bottom wall 25 is disposed centrally of the interior of tank 15. Preferably the suction box 24 is of a width equal to the width of the tank 15 but, if desired, the suction box 24 may be somewhat narrower than the interior of tank 15 so as to facilitate insertion or removal of the suction box 24 if necessary for maintenance or the like. As may be seen in FIG. 2, the arcuate bottom wall 25 of the suction box 24 is disposed above and spaced from the arcuate portion 22 of the bottom 20 of tank 15 so as to define the upper boundary of an arcuate channel 26 between the suction box bottom wall 25 and the bottom wall of tank 15. The side walls 16 and 17 of the tank define the sides of channel 26. At the inlet 27 of the channel 26 and downstream of the point at which the furnish is admitted to the tank 15, there preferably is provided a distribution roll 28 mounted between the sides of the tank on stub shafts 29 (only one such stub shaft 29 is shown) which is rotated by a suitable source of power (not shown). Preferably, distribution roll 28 comprises a hollow shell defined by end supports, such as the end discs 30 which are spaced apart and interconnected by means of a plurality of circumferentially spaced apart rods 32 which are connected at each of their ends with the discs 30. As the furnish is admitted to the tank 15 from the headbox 11, the rotation of the distribution roll 28 enhances pulp dispersion and stabilizes and conditions the flow of furnish.

Figure 5:
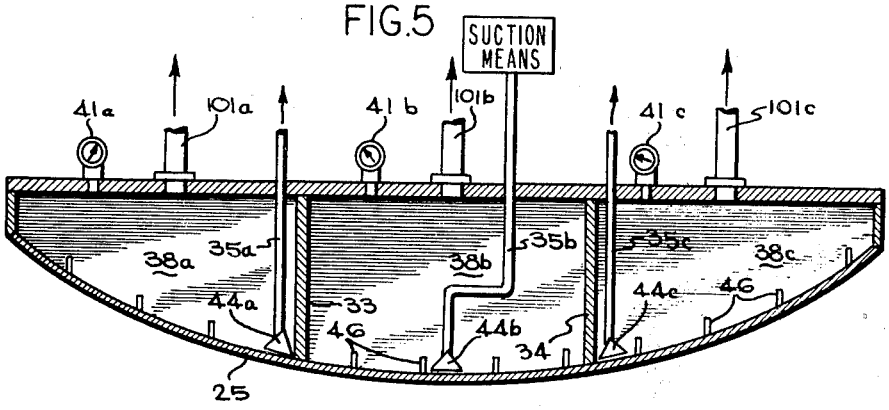
FIG. 5 is a sectional view taken along the longitudinal center plane of the suction box depicted in FIG. 4.
Figure 6:
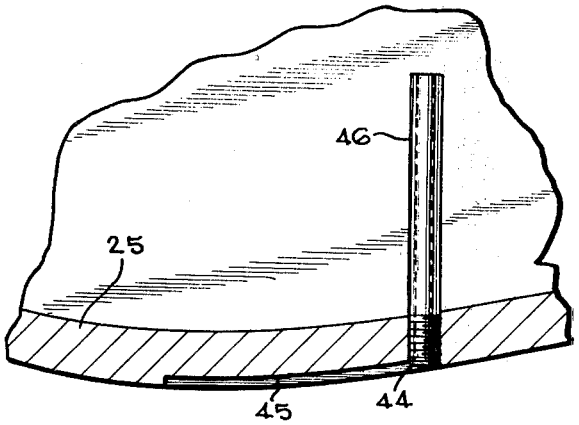
FIG. 6 is a fragmentary view, in section, of a portion of the arcuate bottom wall of the suction box and showing a groove and standpipe arrangement for channeling liquid into the suction box.

As may be best seen from FIG. 5, the suction box 24 preferably includes transverse partitions 33, 34 which divide the suction box into three compartments **38*a*, 38*b*, 38*c* each of which is independently connected to a source of suction (not shown) by pipes 101*a*, 101*b* and 101*c*, respectively. The three compartments 38*a*, 38*b*, 38*c* establish independently controllable areas for applying vacuum as will be hereinafter set forth. Each of the compartments 38*a*, 38*b*, 38*c* is preferably provided with a pressure indicator 41*a*, 41*b* and 41*c*, respectively, for indicating the level of vacuum in each compartment. Further, each of the compartments 38*a*, 38*b*, 38*c* is provided with a liquid removal system comprising a collector pipe 35*a*, *35b* and 35*c*, respectively, having a flared lower end 44*a*, 44*b* and 44*c*, respectively, whose mouth is disposed in close proximity to the inner side of the wall 25 which defines the bottom of the suction box 24 and positioned at or near the lowest point of the compartment. Each collector pipe 35*a*, 35*b*, and 35*c*** is connected to a pump (not shown) so as to permit removal of liquid in the compartments and accumulated at the collectors.

Figure 4:
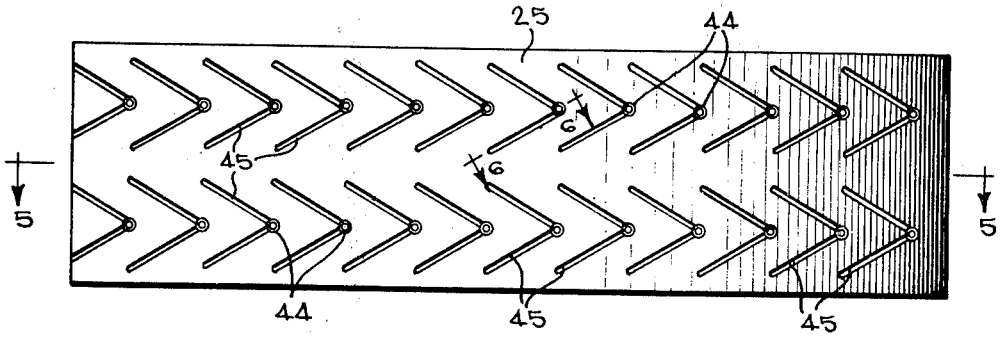
FIG. 4 is a bottom view of the arcuate bottom wall of the suction box depicted in FIG. 2 and showing means for collecting the liquid pulled through the molds and channeling it into the suction box openings.

FIG. 4 is a view of the exterior of the arcuate bottom wall 25 of the suction box 24. As illustrated a plurality of openings 44 are provided in the bottom wall 25 which communicate with the respective compartments **38*a*, 38*b*, 38*c*. Each of the openings connect with one end of a series of grooves 45 (see FIG. 6) which are milled into the bottom wall 25 of the suction box 24 and serve to channel liquid to each of the openings 44 and thence into the compartments 38*a*, 38*b*, 38*c*. Two parallel rows of the grooves 45 and associated openings 44 are shown since the illustrated unit is adapted to simultaneously form two rows of molded articles. The inner side of each of the openings 44 is provided with a standpipe 46 which is secured uprightly in its respective opening 44 in the suction box bottom. Thus, liquid collected in the several grooves 45 flows into the standpipe 46 through which it is drawn into the respective compartment 38*a*, 38*b*, or 38*c*** by the suction provided within that compartment. The liquid is withdrawn from the compartments for disposal or reuse as desired.

A plurality of foraminous molds 47 (FIG. 2) are carried across the outside of the arcuate bottom wall 25 of the suction box in the direction of the flowing furnish by means of an endless, flexible and liquid impervious belt 48 held in sliding contact with the bottom wall 25. With specific reference to FIGS. 7 and 8, each mold 47 is disposed over an opening 49 in the belt 48 and sealably joined along its periphery to the belt 48. The openings 49 in the belt 48 are aligned so that they ride along the rows of openings and grooves 44 and 45 in the bottom wall 25 of the suction box 24.

More specifically, each mold 47, as illustrated, comprises a first frame 50 having a marginal groove 51 for receiving one or more liquid pervious foraminous mold units **50*a* shaped to define the desired product. For example, the mold units 50*a* may include a perforated rigid base member 52 and first and second complimentary screens 53 and 54, respectively, overlying the base member 52 to provide a means for collecting pulp on the mold as liquid is drawn through the screens 53, 54 and base 52. In the depicted mold 47, the base and screen members 52–54 are retained in the groove 51 by a retainer 55 which clamps the base 52 and screens 53, 54 in the groove 51 in the frame 50. The retainer 55 may be held in position by means of bolts 56** or the like.

The mold 47 conveniently may be attached to the belt through the medium of a resilient mounting 57 interposed between the frame 50 and the belt 48. This resilient mounting 57 advantageously may be joined to the belt and to the frame by an adhesive, e.g. epoxy resin, thereby securely joining the mold 47 to the outer side of the belt 48 without requiring projections on the side of the belt 48 which is intended to ride upon and sealably contact the bottom wall 25 of the suction box 24. It will be noted from FIG. 8 that the resilient mounting 57 provides flexibility which aids in providing some conformance when the belt is caused to move around a sprocket or along the arcuate bottom of the suction box.

The frame 50 and retainer 55 may be fabricated as separate units from a metal or hard rubber or plastic (having a Durometer A hardness reading of the order of 80). Alternatively, the frame 50 and the retainer 55 may be integrated as by molding the two members as a single unit using hard rubber or plastic. In the latter instance, it is preferred that the marginal groove 51 open inwardly of the frame to readily receive the base and screen members. Additionally, rubber or plastic of 80 Durometer A hardness will provide, in most instances, the desired resiliency in connection with attachment of the mold to the belt.

The belt 48 is liquid impervious and is of a construction which insures a reasonable flexibility and stability of length, several acceptable types being commercially available. It also possesses at least one surface which will develop a sliding seal with the bottom 25 of the suction box 24 and preferably is not destroyed by frictional engagement therebetween over extended periods of operation. Belts having an acceptable surface are available from commercial sources, such as belts identified as Style 2410 distributed commercially by Globe-Albany Felt Company of Albany, New York which comprise polyester fibers impregnated with a plastisol, the plastisol being more heavily concentrated on one surface of the belt than on the other surface. In any event, the belt is desirably constructed of thread or wire reinforced plastic or rubber to give long wear and a good seal.

The preferred seal with minimum stress upon the belt is obtained when the bottom of the suction box is fabricated in an arcuate shape which is coincident with the belt catenary. It is recognized, however, that reasonable deviations from such coincidence may occur, but with a decrease in the desired freeness of belt movement over the arcuate bottom of the suction box.

The belt 48 desirably is of a width somewhat wider than the width of the mold 47 to be secured thereon. As has been pointed out, two or more molds may be mounted in side-by-side relation across the width of the belt, and this invention is not intended to be limited to any particular belt width. The belt may be secured for movement along its intended course of travel by means of a plurality of cross bars 58 traversing the width of the outer surface of the belt at spaced apart locations along the length of the belt and secured thereto as by bolts 59 whose heads (not visible) are recessed within the belt. Preferably each cross bar is provided at each of its ends with a stub shaft 60–61 pivotally received in appropriate links 62–63 of chains 64–65 which parallel the marginal edges of the belt.

The chains 64–65 with the belt 48 disposed therebetween are passed over sets of sprockets **66*a*, 66*b*, 66*c*, and 66*d*, for example, (see FIGS. 1, 2, 3) to define the course of belt travel. Preferably, the shaft 70 of one or more sets of sprockets (66*b* for example) is adjustably mounted in an elongated slot 71 in each of spaced apart parallel mounting beams (only one beam 104 is shown in FIG. 2) secured at one of their ends to the apparatus superstructure or other convenient point of attachment with their other end extending angularly upward. The angular position of each set of beams 104 preferably is chosen to coincide with the radial force exerted by the chains and belt trained around the sprockets on the shaft so that adjustment of the shaft position along the slot changes the tension in the chains and belt. This adjustment of the tension is accomplished by moving the sprocket shaft along its slots by means of a threaded shaft 74 and nut means 75 secured on each support member 104 and engaging the shaft. One or more of the sets of sprockets, set 66*a* for example, is driven by a motor means 76 connected to the sprocket set 66*a* by a gear reducer 77 and chain means 78 engaging a drive sprocket 79 keyed to the shaft 105** of the sprocket set.

Figure 1:
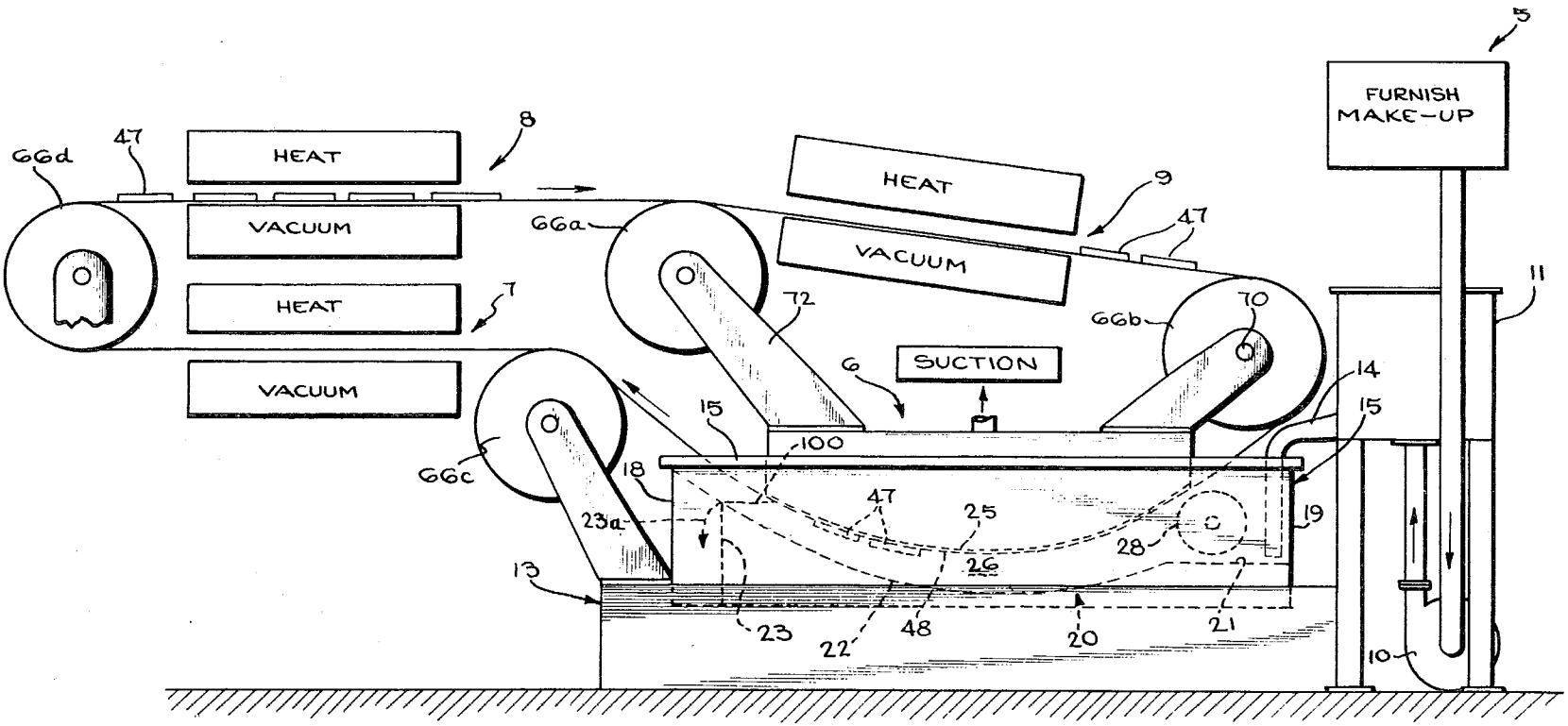
FIG. 1 is a representation of a molded fibrous product making machine of the type with which apparatus in accordance with the present invention may be employed.

As may be seen in the drawings, the chains 64, 65 with the mold-carrying belt disposed therebetween are trained around the sprocket set **66*b*, thence downwardly to slidably contact the arcuate bottom 25 of the suction box. As desired, the belt may be guided into contact with the suction box by a flat spring means 106. The chain and belt assembly emerges from the pulp furnish and is trained around a second sprocket set 66*c* and such other sprocket sets (66*d* for example) as appropriate to be directed to processing stations located away from the tank 15. Such processing stations are depicted in FIG. 1 and usually comprise dewatering units 7, 8 and 9, respectively, for dewatering the fibrous layer collected on each mold. From these external processing stations, the chain and belt assembly may be directed over a driven sprocket set 66*a*, thence along a generally horizontal path to the point of beginning at sprocket set 66*b*. During the time when the chains and belt are horizontally disposed in the span between sprocket sets 66*a* and 66*b*, the molds will be noted to be on the uppermost surface of the belt so that the dewatered molded products may be removed from the molds by a jet of air directed from nozzle 82** against the bottom surface of the mold to force the molded product away from the mold to be collected by appropriate means (not shown).

In the drawings, the chains 64, 65 are depicted as unsupported during the interval while beneath the surface of the furnish with the belt being held in contact with the bottom wall 25 of the suction box 24 by the tension on the chains and belt. Alternatively, arcuate channel means may be provided along the opposite bottom edges of the suction box 24 to support and guide the chains, hence at least partly control the frictional engagement between the belt 48 and the bottom 25 of the suction box 24.

With reference to the apparatus thus far described, the furnish, e.g. wood fibers suspended in water, is pumped from a furnish makeup unit 5 into the headbox 11 to the liquid level determined by the height of the overflow 12. Depending upon the product, these fibers may be of a particular kind and present in a selected quantity. One product frequently produced by pulp molding processes is a paper plate. The pulp for a paper plate may comprise groundwood, reclaimed fibers and/or other types of fibers. For purposes of simplicity and clarity, a paper plate product will be referred to in describing the invention, but it is not intended that the invention be limited to any specific product.

Control over the concentration and distribution of the fibers in the furnish at all points along the length of the confined channel has been found to be important in achieving the desired molded product. The pulp furnish is metered under the force of gravity from the headbox 11 into the upstream end of the forming tank 15, preferably entering the tank at a point beneath the surface of the body of furnish so as to minimize the entrainment of air. The quantity of furnish entering the tank 15 per unit of time is selected by adjustment of the pressure head at the headbox 11, i.e., by selection of the height of the overflow 12. The surface level of the furnish in the tank 15 is selected by the height of the weir 23 at the downstream end of the channel 26.

Within the tank, the furnish flows from the upstream end of the tank 15 along the arcuate channel 26 defined by the arcuate bottom 25 of the suction box 24, the side walls 16, 17 and the contoured bottom 20 of the tank 15. Contrary to the prior art where the furnish was merely pumped into large open tanks to create a pond of furnish with little or no control over either the direction or conditions of the flow of the furnish through the tank, the movement of the furnish through the tank 15 is channeled along an arcuate path in a confined flow pattern generally parallel to the line of travel of the molds for effective transfer of fibers from the furnish to the molds in response to suction applied across the molds as will be further discussed. Additionally, this arcuate channel reduces the amount of furnish in active use at any time. Other advantages will appear from the subsequent description.

Preferably, the incoming furnish is conditioned by the distributor roll 28 disposed transversely between the side walls 16, 17, adjacent the upstream end of the tank and downstream of the point at which pulp enters the tank from the headbox 11. The rotational axis of the distributor roll is disposed transversely of the desired direction of furnish flow so that upon rotation of the roll, the flow of incoming furnish is interrupted to insure dispersion of the fibers into a nonagglomerated state and to properly condition the flow. Specifically, as the incoming stream of furnish flows past the several transverse rod elements 32 of the distributor roll 28, the flow is provided with a large number of eddy swarms or turbulence which disburses the fibers causing them to advance with the flowing stream to be presented to the molds in a highly disoriented state. Preferably, the distributor roll is rotated relatively slowly to prevent accumulation of fibers on the leading edges of its transverse rods and also to insure against the development of channelized flow conditions.

In the absence of an appropriate volume of furnish overflowing from the downstream end of the channel, the fibers within the furnish in the channel become oriented due to the lack of agitation, contrary to the desired random orientation imparted to the fibers at the upstream end of the channel and which has been found to produce the disclosed product. Accordingly, in the preferred method, about 25% of the incoming furnish volume is caused to overflow from the downstream end of the channel. This preferred overflow insures that there is sufficient volume of furnish adjacent the downstream end of the channel as will result in good agitation of the furnish in this part of the channel under the selected flow conditions and the fibers of the furnish continue in their disoriented state and in a relatively low concentration substantially throughout their period of residence in the channel. Significantly greater percentages of overflow introduce less economical operating conditions due to the necessity of recirculating large volumes of furnish. Low overflow percentages, however, result in such fiber concentration and orientation as causes the molded products to exhibit less improvement in their strength.

The desired fiber distribution within the furnish is also a function of the fiber population in the furnish, i.e. the pulp consistency. To produce an economical molding operation employing the prior art methods and apparatus, it has been common heretofore to use a furnish which contains a relatively large population of fibers so that many fibers would be readily available for accumulation on a mold in a minimum of exposure time of the mold in the furnish. As noted before, such prior art concepts have been found unsuitable to produce products having the uniform strength and other characteristics as found in the disclosed product at relatively high production rates. In accordance with one aspect of the present invention, the consistency of the furnish employed is initially established at a relatively low value, e.g. 0.3% and kept at a low value throughout the length of the channel through which the furnish is flowed and during the time when the molds are exposed to the furnish. Preferably, the consistency of the furnish in the channel does not rise to over about 1 ½% at any time so that the flow controls set forth herein are effective to disperse the fibers in good random orientation in the furnish and maintain them so dispersed when they are introduced to a mold at any point along the channel.

As noted above, the belt 48, with the molds 47 secured on its outer side, is guided beneath the surface of the flowing furnish along the arcuate bottom of the suction box in sliding contact with its bottom wall 25. In this manner, one side of each of the molds is exposed to the furnish for a selected period of time depending upon the rate of belt movement and the length of the belt course beneath the surface of the furnish. By virtue of its mounting on the belt, each mold is sealably joined at least along its periphery to the belt so as to establish fluid flow communication through the belt and mold assemblage. Since the belt lies relatively flat against the bottom wall 25 and in sealing engagement therewith as the molds on the belt are moved along the bottom wall 25 and over the grooves 45 and openings 44 therein, the partial vacuums in the respective compartments of the suction box create a suction which draws liquid from the furnish through the foraminous molds to cause an accumulation of fibers on the outer surface of each mold as it is exposed to the furnish. By selection of the groove positions, including their relative spacing, and with a view to the particular mold geometry, continuous and constant suction may be applied to each mold over substantially the entire arcuate length of the suction box. Specifically referring to FIG. 4 which shows two parallel rows of grooves 45 and cooperating openings 44 in the bottom of the suction box, one row for each row of molds carried on the belt 48, each opening 44 is preferably provided with two grooves 45 radiating from the opening with an angle therebetween such as will cause the two grooves at their extremities to be spaced apart by about the diameter or width of the mold passing thereover. The two grooves thus form a V whose apex is at the opening 44. The several V's accompanying the several openings making up each row are aligned with their apices directed in a single direction, that is, along the row. The grooves each terminate on a line extending perpendicularly transversely through the opening associated with the successive V in the row. Thus, as a mold is moved along and over a row of V's, the mold is constantly subjected to suction. Further, the suction experienced by each moving mold remains substantially constant because the total area of the grooves and/or openings under each mold at any given point along a row is substantially constant. Thus, the accumulation of the fibers on each mold preferably commences immediately upon immersion of the mold in the furnish slurry and continues until the mold emerges from beneath the surface of the furnish.

In the preferred method, the molds are moved forwardly with the furnish at approximately the same rate of progression as the furnish so that relative movement between the molds and furnish does not disrupt the fiber accumulation process, such as by "sweeping" the fibers off the mold or having them deposit in an undesirable relation with each other due to the mold moving faster than the fibers. For example, when moving the furnish forward at 150 feet per minute (fpm), moving the molds forward at a rate more than about 160 fpm or less than about 140 fpm creates streaks and resultant weak regions in the product. Whereas differences in the relative speeds of the furnish and molds of about 10 feet per minute (fpm) will result in improved fiber accumulation, it is preferred to maintain these speeds with less than about 5 fpm difference therebetween. At other flow rates of the furnish, the speed of mold movement relative to the rate of furnish flow must likewise be adjusted to avoid the noted undesirable disruption of the accumulated fibers.

Preferably, the molds are immersed in the furnish at the head or upstream end of the tank where the fibers quickly cover the mold surface in response to suction. This rapid accumulation of fibers has been found to result in an improved product. The rate of deposition diminishes rapidly as the fiber layer builds up and reduces the porosity of the mold. Deposition of the fibrous layer on the mold continues, however, for a time determined by the duration of applied suction. Preferably, the duration of suction and mold residence beneath the surface of the furnish are approximately coterminal in point of time so as to avoid possible washing of fibers off the mold by the flowing furnish after removal of the suction.

The molds with their respective accumulations of fibers are moved out of the tank to subsequent processing stations where the fibrous product is subjected to further suction, pressure and/or heat to remove the residual moisture and produce dry self-sustaining products. The dried products may be conveniently separated from the molds by a jet of air through the molds, as through the nozzle 82, and collected by appropriate means (not shown). The overflow of furnish may be recycled to the furnish makeup section for mixing with incoming furnish.

Figure 9:
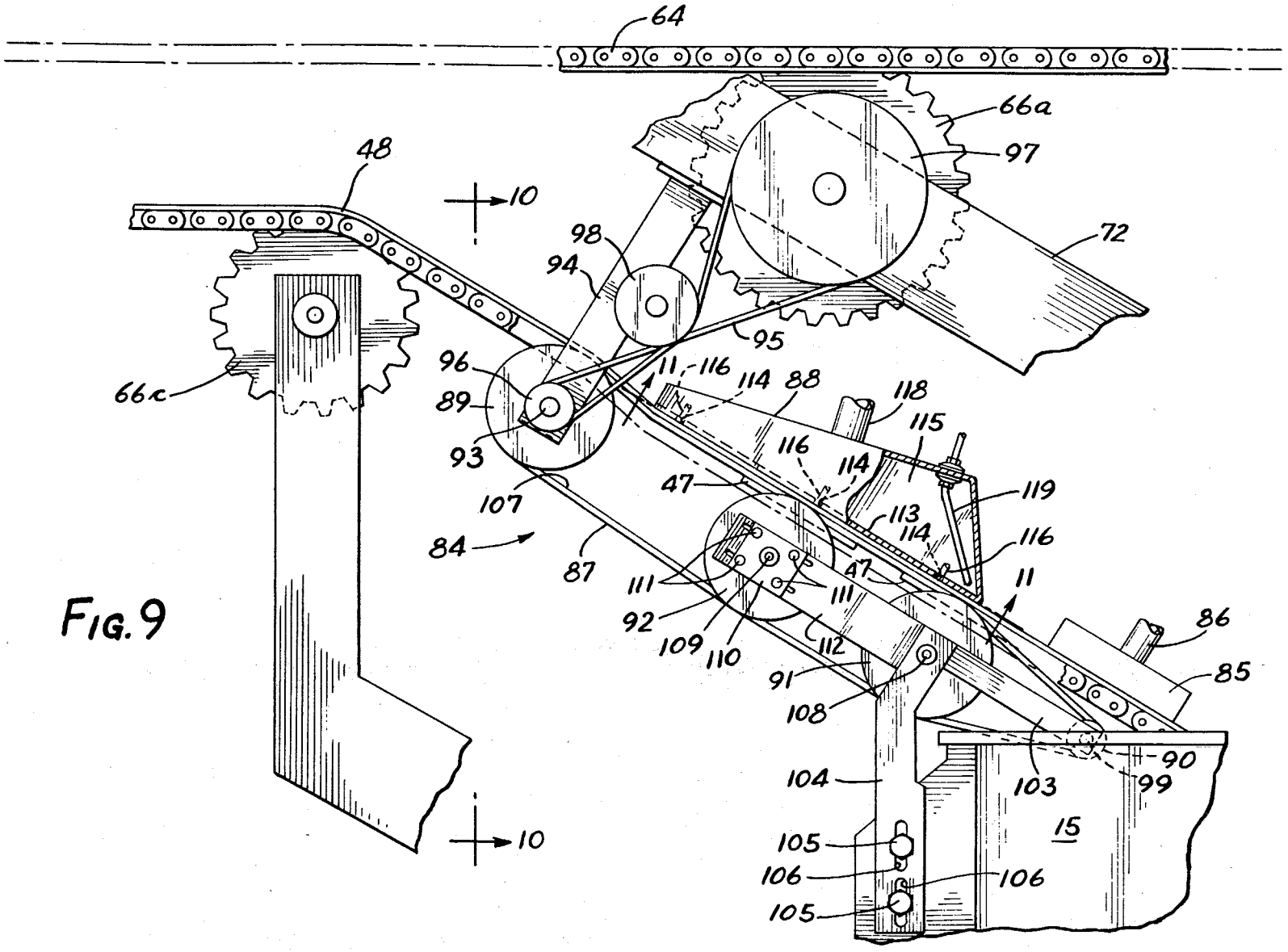
FIG. 9 is a partial elevational view illustrating apparatus in accordance with the present invention for forming smooth exposed surfaces on and removing water from the pulp pads or mats disposed on the product molds, a portion of the suction box being broken away for clarity.

With reference to FIGS. 9, 10 and 11, the present invention provides means, indicated generally at 84, for simultaneously dewatering the molded fibrous or pulp products disposed on the molds 47 and enhancing the smoothness of the exposed surfaces of the fibrous products on the molds after the molds emerge from the furnish tank 15. The dewatering and surface smoothing means 84, to be hereafter described, serves to remove a portion of the liquid, conventionally water, from the molded fibrous products retained on the molds 47 prior to passage of the molds and associated fibrous products through the aforereferenced dewatering units 7, 8 and 9.

Prior to passing the molds 47 and associated fibrous products through the dewatering and surface smoothing means 84, the molds are passed beneath a dry box 85 of conventional design which is mounted by suitable means (not shown) adjacent the downstream or exit end of the furnish tank 15. The dry box 85 serves to effect the flow of air upwardly through the fibrous product deposits and associated foraminous molds 47 so as to remove some of the liquid content of the fibrous products. The air and entrained liquid particles are passed outwardly of the dry box 85 through a suitable suction tube or pipe 86 in a known manner. With the fibrous products formed on the molds 47 having a consistency of approximately 5 to 10 percent when they emerge from the furnish channel 26, the dry box 85 is capable of increasing the consistency of the fibrous product up to approximately 15 percent when molds 47 are passed beneath the dry box.

After passing beneath the dry box 85, the molds 47 and the associated fibrous products carried thereon are passed between a lquid and gas impervious elastic belt 87 and a suction box 88 of the dewatering and surface smoothing means 84. The belt 87 has a transverse width substantially equal to the width of the belt 48 and preferably comprises an endless belt which is trained over pairs of guide pulleys 89 and 90 and over pressure rollers 91 and 92. The belt 87 is supported in a manner to define a run which is aligned with a run of the belt 48 after the belt 48 emerges from the furnish tank 15.

The belt 87 is secured along its marginal edges to pairs of parallel endless guide belts 107 which, in the illustrated embodiment, comprise flexible but generally inextensible V-shaped belts. The V-belts 107 are reeved over the guide pulleys 89 and 90 and over the pressure rollers 91 and 92 so as to stabilize the belt 87 and prevent undesirable sagging of the elastic belt 87 along the run aligned with the mold carrier belt 48.

The guide pulleys 89 comprise a pair of double V-grooved pulleys which are fixedly mounted in lateral spaced relation on a shaft 93 rotatably supported at its opposite ends on the lower ends of a pair of support arms 94. The support arms 94 are secured at their upper ends to the lower surfaces of a pair of laterally spaced support beams 72 which support the aforenoted drive sprocket 79. A drive belt 95 interconnects a driven pulley 96, secured on an outer end of the shaft 93, to a drive pulley 97 rotatable with the drive sprocket **66*a* to effect rotation of the guide pulleys 89. The drive belt 95 has one run thereof trained over an idler pulley 98 such that as the guide pulleys 89 are rotated upon rotation of the sprocket 66*a* (the power sprocket for advancing chains 64, 65), the run of belt 87 aligned with belt 48 is caused to advance in the same direction and at the same forward rate of progression as the molds 47 carried by the belt 48.**

The guide pulleys 90 also comprise a pair of spaced double V-groove pulleys which have smaller diameters than the guide pulleys 89. The guide pulleys 90 are supported on a transverse shaft 99 having its opposite ends supported by and between a pair of downwardly inclined support arms 103 secured at their upper ends to vertical support legs 104. The support legs 104 are mounted on the furnish tank 15 by bolts 105 received through elongated slots 106 in the support legs 104 to allow vertical adjustment of the support legs 104 relative to the tank 15.

The pressure rollers 91 and 92 are made of a relatively soft resilient material capable of conforming to the contour of the molds 47, and thus the pulp products carried by the molds, as the molds are passed between the pressure rollers and the suction box 88. The pressure roller 92 is preferably made of a sponge rubber material, but alternatively may comprise a soft roller brush. The pressure roller 91 is secured on a transverse shaft 108 having its opposite ends rotatably supported by the upper ends of the support legs 104. The pressure roller 92 is fixed on a transverse shaft 109 having its opposite ends rotatably supported by end plates 110. The end plates 110 are secured by bolts 111 to upwardly inclined support arms 112 affixed to the support legs 104. The bolts 111 are received through elongated slots in the plates 110 such that the end plate 110, and thus the pressure roller 92, may be adjusted along the lengths of the support arms 112.

The pressure rollers 91 and 92 serve to urge the belt 87 upwardly against the opposing surface of the belt 48 and the exposed surfaces of the fibrous products carried by the molds 47 to insure the desired suction action of the suction box 88 on the belt 87. By providing for adjustment of the pressure roller 91 along the support arms 112, the distance between the pressure rollers may be varied to accommodate products and molds of different size, considered longitudinally along the belt 48. The vertical adjustability of the support legs 104 allows adjustment of the pressure rollers 91 and 92 relative to the suction box 88 so as to selectively vary the pressure exerted by the pressure rollers against the belt 87 and the molds 47 carried on the belt 48.

The pressure rollers 91 and 92 have their opposite ends formed to provide annular double V-grooves for receiving the V-belts 107 which support the marginal edges of the elastic belt 87. Depending upon the resilient material selected for the pressure rollers 91 and 92, it may be preferred to make the portions of the rollers having the V-grooves formed therein as separate pulley elements which are secured on the respective roller shafts 108 and 109.

As noted, the belt 87 is made of a liquid and gas impervious elastic material. Additionally it is desirable that the belt 87 have inherent release characteristics such that when the belt disengages the molded fibrous products carried on the molds 47, the fibers will not be drawn away from the fibrous mat, generally termed "picking". Still further, the belt 87 should exhibit long wear and elastic or shape retention properties. To this end, the belt 87 is preferably made of a silicon rubber material such as available from Atlantic India Rubber Company, Chicago, Illinois, under the tradename Compound SR-200.

The suction box 88 is mounted by suitable means (not shown) to generally overlie the run of the belt 87 aligned with belt 48, as shown in FIG. 9. The suction box 88 has a planar bottom member 113 which is preferably made of ⅜ inch thick stainless steel so as to present a low friction surface for sliding engagement with the side of the belt 48 opposite the side upon which the molds 47 are mounted. Alternatively, the bottom member 113 of the suction box 88 may be made of a suitable strength planar material having a sintered polytetrafluoroethylene surface for engagement with the belt 48.

The bottom member 113 of the suction box 88 has a plurality of suction openings 114 therethrough (FIG. 11) which communicate with a vacuum chamber 115 defined within the suction box 88. Standpipes 116 are secured in upstanding relation to the bottom member 113 within the vacuum chamber 115 to overlie each of the suction openings 114. Suction grooves 117 are formed in the lower surface of member 113 to provide suction communication between the suction openings 114. In the illustrated embodiment two rows of suction openings 114 are provided in the bottom member 113 of the suction box 88 for cooperation with two rows of sequentially spaced molds 47 carried on the belt 48.

A vacuum or suction pipe 118 is secured to the upper surface of the suction box 88 to create a vacuum in the chamber 115. A suction tube 119 is supported within the chamber 115 to draw off liquid from the interior of chamber 115 which has been drawn through the standpipes 116 during removal of liquid from the fibrous products on the molds 47 as they pass beneath the suction box 88.

During passage of the molds 47 and associated pulp or fibrous products between the belt 87 and the suction box 88, suction acting through the openings 114 and suction grooves 117 in the bottom member 113 of the suction box continuously acts through the openings in the impervious belt 48 and the foraminous molds 47 to draw the belt 87 into pressurized engagement with the adjacent exposed surfaces of the fibrous products carried on the molds 47. As noted the pressure rollers 91 and 92 provide additional upward pressure against the belt 87 to effect full surface sealing contact with the belt 48, molds 47 and associated pulp products on the molds and thereby assure the desired suction. The suction force applied to the belt 87 by the suction box 88 is sufficient to cause the belt to squeeze liquid from the pulp products carried by the molds 47. The liquid squeezed from the pulp products is drawn upwardly through the foraminous molds 47, the suction grooves 117 and the suction openings 114, and the standpipes 116 whereafter it flows to the lower end of the chamber 115 and is removed through the suction tube 119. In addition to the dewatering action of the belt 87 and suction box 88, the pressure of the belt 87 against the outer exposed surfaces of the pulp layers carried by the molds 47 smooths the pulp surfaces to provide a product of improved surface smoothness. This pressure may also be employed to densify the pulp and reduce the thickness of the molded products. It will be understood that additional pressure rollers, similar to the pressure rollers 91 and 92, can be provided to underlie the suction box 88 and exert an additional upward pressure against the belt 87.

The belt 87 may have a pattern or logo embossed on its outer surface for imprinting the opposed outer surfaces of the pulp products carried by the mold 47 during dewatering and surface smoothing as the molds 47 pass between the belt 87 and suction box 88.

Desirably, the pulp furnish is moved along the channel 26 in a state of turbulent, i.e., nonlaminar, flow at least in the upstream region of the channel and during at least the initial period of fiber accumulation on the molds. The dispersion of the fibers within the channel 26 accompanying the turbulent flow is believed to introduce the fibers to every part of each mold surface in a nonaligned state with respect to each other, with some fibers being oriented perpendicularly, or approximately so, to the mold surface. Observation of the product indicates that as the fibers are accumulated onto each mold which is moving at about the same rate of forward travel, a substantial number of fibers appear to lie in planes which extend through the thickness of the accumulated layer, thereby interlocking the fibers and consequently enhancing the strength of the product. Further, it has been noted that a product produced as outlined above, exhibits unexpected bulk per unit weight as compared to a product made by the prior methods. This is also indicatie of substantial interlocking of fibers. The benefits accruing from the method as described include the capability (1) to produce a product of equal strength with the prior art but using fewer fibers, with concomitant savings in raw material costs, or (2) at the same cost in raw materials, to produce a stronger product than the prior art, which in many instances is critical to the commercial acceptability of the product.

In carrying out the described method, it is preferred that the elongated channel 26 be arcuate, that is, curved along its length to promote economical operation. For example, less expensive apparatus is required to move the molds through the arcuate channel than through a straight channel due to the problems associated with maintaining the necessary sealing engagement of the belt with the suction box. Moreover, controlled flow of the furnish is established as described herein at minimum cost in equipment and readily maintained over extended periods of operation.

In operation of the apparatus shown in the Figures, the flow of furnish through the arcuate channel 26 in the tank 15 may be regulated principally by the cross-sectional area of the channel along its length. Initially, a predetermined flow of furnish from the headbox 11 into the upstream end of the tank 15 is established. The magnitude of this flow is chosen to provide sufficient furnish within the tank 15 at the upstream end of the channel 26 at all times as will cause the furnish to flow through the channel at a desired velocity. This velocity is maintained constant along the length of the channel preferably by reducing the cross-sectional area of the channel in the downstream direction. It has been found that the continual withdrawal of liquid from the furnish through the molds reduces the velocity of furnish flow within the channel. Maintaining a gross pressure differential across the length of a channel of constant cross section has been found insufficient to produce the product disclosed herein, due in part to the facts that liquid is continually being withdrawn at different rates through each of several moving molds, and that the withdrawal rate through each mold is continually changing as a function of the fiber build-up on the mold. In the method and apparatus disclosed herein, the cross section of the channel 26 is decreased in the direction of furnish flow by an amount sufficient to compensate for the noted velocity decrease due to liquid withdrawal and thereby maintain a relatively constant velocity of furnish flow along the entire length of the channel for any flow rate selected through adjustment of the pressure head at the upstream end of the channel. In the absence of this relatively constant velocity along the length of the channel, the molded pulp product obtained lacks the desired improved strength and other characteristics described hereinafter.

It has been found, for example, that at furnish flow rates along the channel of 150 feet per minute, the desired constant velocity is readily obtainable along an arcuate channel of constant width having a radius of about 8 feet within which the vertical depth of furnish varies from about 18 inches at the upstream channel end of the channel to about 6 inches at the downstream end of the channel. If desired, in some instances it may be advantageous to narrow the width of the channel with or without decreasing the depth thereof.

Figure 7:
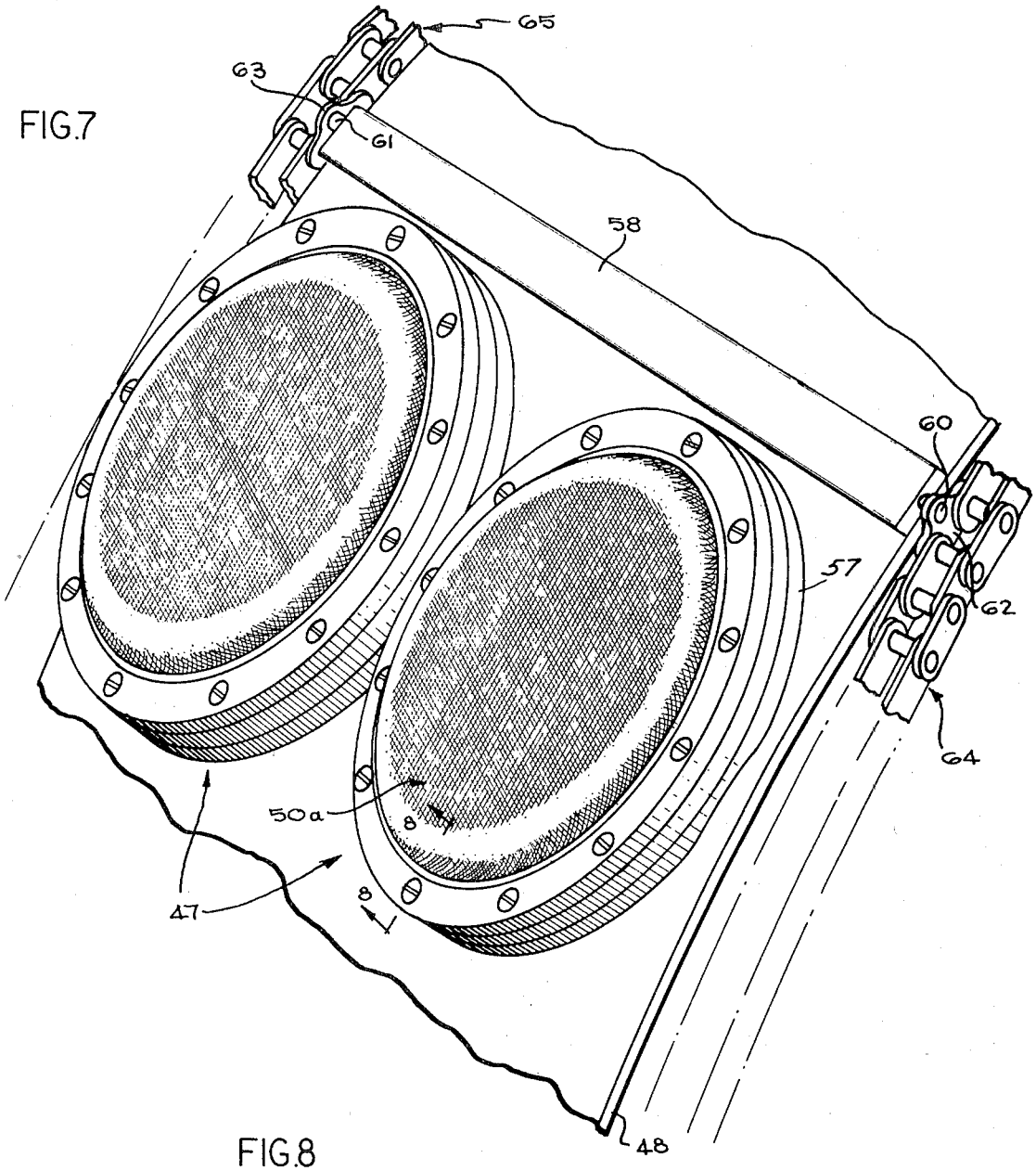
FIG. 7 is a fragmentary view of an endless belt of one type employed in the present invention and showing a plurality of molds secured thereon.
Figure 8:
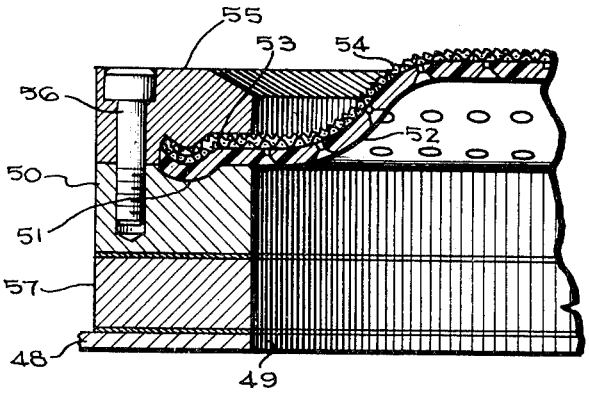
FIG. 8 is a fragmentary view, in section, taken along the line 8—8 of FIG. 7 and showing one means for securing a mold to the endless belt over an opening in the belt.

Employing the method and apparatus described herein, a furnish comprising about 70% groundwood and about 30% kraft fibers made up with water to about 0.3% fiber consistency and having a freeness of about 200 was moved through an arcuate channel as described hereinabove at a flow rate, i.e., velocity, of about 150 feet per minute. This velocity was sufficient to establish turbulent flow of the furnish in at least about the first half of the length of the arcuate channel. About 25% of the incoming volume of furnish overflowed from the downstream end of the channel. This overflowing furnish had a consistency of about 0.8%. A plurality of molds, each defining a 9 inch diameter circular plate, were moved with the furnish at a rate of about 150 feet per minute. Two molds were positioned side-by-side on the belt as depicted in FIG. 7 of the accompanying drawings.

In this example, reduced pressures of 3, 5 and 7 inches of mercury (with respect to atmospheric pressure) were established within the suction box chambers 38*c*, 38*b* and 38*a*, respectively, thereby creating a suction within each chamber which drew liquid through the molds as they moved along the bottom wall 25 of the suction box 24. The fibrous layer collected on the outer side of each mold was about 0.047 inch (after dewatering).

As noted, after the molds 47 and associated pulp or fibrous layers carried on the molds pass from the furnish tank 15, the pulp may have a consistency of approximately 5 to 10 percent. The dry box 85 is preferably sufficient to increase the consistency of the pulp layers on the molds to approximately 15 percent. The suction box 88 and pressure contact of the belt 87 are adjusted to increase the consistency of the pulp layers on the molds 47 to approximately 20 percent as the molds pass through the dewatering and surface smoothing means 84. This may be accomplished by establishing sufficient vacuum within the suction box 88 to effect a suction or vacuum of approximately 11–15 inches mercury (relative to atmospheric pressure) acting on the molds 47 through the openings in the belt 48, coupled with a pressure of approximately 7 psi applied by the belt 87 through the pressure rollers 91 and 92.

The fibrous layers on the molds were then passed to conventional drying stations, such as 7, 8 and 9, where applied heat and vacuum removed the residual moisture in the layers. The dried layers were thereafter ejected from the molds with air jets and collected.

The method and apparatus disclosed herein includes maintaining the molds in a generally nonvertical orientation, that is, the water drawn through the molds is pulled generally vertically upwardly. This mold orientation presents the outer surface of the mold to the furnish in the preferred position, relative to the fibers in the furnish, for good accumulation and retention of the fibers on the mold surface in that there is a minimal relative movement between the molds and furnish and minimal sweeping of fibers off the molds.

While preferred embodiments have been shown and described, it will be understood that there is no intent to limit the disclosure, but rather, it is intended to cover all modifications and alternate constructions falling within the spirit and scope of the invention as defined in the appended claims. For example, it is contemplated that fibers of many kinds may be molded into various products employing the method and apparatus disclosed herein. Specifically, glass and synthetic fibers of the order of staple length are particularly suitable as raw materials for producing molded products and the term "pulp" as employed herein is not intended to limit the invention to paper fibers.

What is claimed is:

1. In an apparatus for making molded fibrous products, the combination comprising means defining a confined channel adapted to receive a quantity of furnish, first belt means movable along a path which passes through said channel, a plurality of foraminous product molds supported in sequential relation along said first belt means, said first belt means being liquid impervius except for the portions on which said product molds are supported, first suction box means defining a boundary surface of said confined channel along which said first belt means is caused to travel, said first suction box means being operable to apply suction to the sides of said product molds adjacent said boundary surface and effect accumulation of pulp on the side of each product mold exposed to furnish within said channel, said belt means supported for movement along a path including a run adapted to engage the exposed surfaces of pulp on said product molds after leaving said channel, and second suction box means supported in opposed relation to said run of said second belt means and adapted to apply suction to the side of said first belt means opposite the side upon which said product molds are mounted, said second belt means being elastic and cooperable with said second suction box means to contact substantially the full exposed surfaces of pulp on said product molds in pressurized engagement therewith to remove a portion of the liquid remaining in the pulp retained on said product molds and form smooth exposed surfaces on said retained pulp.

2. The combination of claim 1 including pressure roller means supporting said second belt means in a manner to urge said run thereof into pressurized engagement against the exposed surfaces of pulp on said product molds.

3. The combination of claim 2 wherein said pressure roller means includes at least one resilient roller which is adjustable to selectively vary said pressurized engagement with said exposed surfaces of pulp on said product molds.

4. The combination of claim 1 wherein said second belt means comprises a generally flat belt defining a closed loop, and including opposed pairs of guide pulleys having endless connecting belts reeved thereover, said flat belt being secured along its marginal edges to said connecting belts, and drive means operatively connected to at least one of said guide pulleys to effect rotation thereon in a direction to move said run of said second belt means in the direction of movement of said first belt means during operation of said apparatus.

5. The combination of claim 4 including a resilient pressure roller supported between and generally parallel to the axes of rotation of said pairs of guide pulleys for engagement with said run of said second belt means to bias said second belt means against the pulp on said product molds when in engagement with said second belt means.

6. The combination of claim 4 wherein said drive means is operable to effect movement of said run of said second belt means at a rate of travel substantially equal to the rate of travel of said first belt means.

7. In an apparatus for making molded fibrous products which includes means defining a confined channel, means for introducing furnish into said channel, first belt means movable along a path including a first run passing through said channel and a second run passing from said channel, a plurality of liquid pervious product molds sequentially mounted on and movable with said first belt means for exposure to furnish within said channel, first suction box means defining a boundary of said channel along which said first run of said first belt means passes, said first suction box means being adapted to subject said product molds to suction within said channel in a manner to accumulate pulp on the sides of said product molds exposed to said furnish in said channel; the improved combination therewith comprising dewatering and surface smoothing means including second belt means defining a generally closed loop having a run in substantial alignment with said second run of said first belt means, second suction box means, means supporting said run of said second belt means and said second suction box means in opposed relation with said second run of said first belt means movable therebetween, said second belt means being elastic and cooperable with said suction box means to effect pressure engagement of said second belt means with substantially the full exposed surfaces of pulp on said product molds to remove a portion of the liquid remaining in said pulp retained on said product molds and form relatively smooth surfaces on said retained pulp on said product molds after passing from said channel.

8. The improvement of claim 7 wherein second suction box means is supported for engagement with the side of said first belt means opposite the side on which said product molds are mounted, and including means biasing said run of said second belt means against the pulp on said product molds during movement between said run of said second belt means and said second suction box means.

9. A method for removing liquid from and forming a smooth exposed surface on a pulp deposit on a foraminous product mold after removal of said mold and associated pulp deposit from a furnish channel, said product mold being mounted on and carried by a flexible belt which is liquid impervious except for the portion on which said product mold is mounted, said method comprising the steps of passing said flexible belt and product mold between an elastic belt and a suction box, pressing said elastic belt against substantially the full exposed surface of said pulp deposit while simultaneously subjecting the side of said product mold adjacent said flexible belt to suction from said suction box so as to compress the pulp fibers and cause liquid within said pulp deposit to be withdrawn therefrom and passed through said foraminous product mold.

10. The method as defined in claim 9 including the further step of removing said liquid from said foraminous product mold in a manner to prevent liquid back pressure from acting against said product mold during liquid removal from said pulp deposit.

* * * * *

UNITED STATES PATENT OFFICE

CERTIFICATE OF CORRECTION

Patent No. 3,990,940 Dated November 9, 1976

Inventor(s) Charles A. Lee; Warren R. Furbeck

It is certified that error appears in the above-identified patent and that said Letters Patent are hereby corrected as shown below:

Col. 13, line 15, "indicatie" should be -- indicative --.

Col. 15, line 32, after nel, "said" should be -- second --.

Col. 16, line 31, after said and before suction, insert -- second --.

Signed and Sealed this

Fifth Day of April 1977

[SEAL]

*Attest:*

RUTH C. MASON
*Attesting Officer*

C. MARSHALL DANN
*Commissioner of Patents and Trademarks*